US005816685A

United States Patent [19]

Hou

[11] Patent Number: 5,816,685

[45] Date of Patent: Oct. 6, 1998

[54] COMBINED UMBRELLA HANDLE AND FLASHLIGHT

[76] Inventor: Hsien-Te Hou, No. 5, Lane 279, Chung Cheng Rd., Yung-Kang City, Tainan Hsien, Taiwan

[21] Appl. No.: 842,364

[22] Filed: Apr. 24, 1997

[51] Int. Cl.[6] ..... F21L 7/00; A45B 3/02

[52] U.S. Cl. ..... 362/205; 362/102; 362/202; 362/205; 362/208

[58] Field of Search ..... 362/102, 202, 362/205, 120, 118, 116, 194, 208

[56] References Cited

U.S. PATENT DOCUMENTS

| | | | |
|---|---|---|---|
| 1,128,167 | 2/1915 | Manson . | |
| 1,177,241 | 3/1916 | Gay . | |
| 1,723,780 | 8/1929 | Hayhoe | 362/102 |
| 1,836,034 | 12/1931 | Luchansky | 362/102 |
| 2,372,471 | 3/1945 | Campbell . | |
| 3,443,085 | 5/1969 | Steltzer et al. | 362/202 |
| 3,510,643 | 5/1970 | File | 362/26 |
| 4,609,976 | 9/1986 | Geissler | 362/202 |
| 4,733,337 | 3/1988 | Bieberstein | 362/206 |
| 4,872,468 | 10/1989 | Cole | 135/16 |
| 5,165,782 | 11/1992 | Maglica et al. | 362/208 |
| 5,331,528 | 7/1994 | Chen | 362/205 |
| 5,386,352 | 1/1995 | Chu | 362/206 |
| 5,463,536 | 10/1995 | Chou et al. | 362/102 |
| 5,493,480 | 2/1996 | Huang | 362/102 |
| 5,544,888 | 8/1996 | Pellegrini | 473/220 |
| 5,595,434 | 1/1997 | Pasch et al. | 362/102 |
| 5,707,135 | 1/1998 | Miller, Jr. | 362/102 |

FOREIGN PATENT DOCUMENTS

| | | | |
|---|---|---|---|
| 885743 | 6/1966 | Canada | 362/102 |
| 807599 | 10/1936 | France | 362/102 |
| 384590 | 11/1923 | Germany | 362/102 |
| 183353 | 6/1936 | Switzerland | 362/102 |
| 1242396 | 8/1971 | United Kingdom | 362/194 |
| 2 224 931 | 5/1990 | United Kingdom | 362/102 |
| 92/21410 | 12/1992 | WIPO | 362/102 |

*Primary Examiner*—Ira S. Lazarus
*Assistant Examiner*—Ljiljana V. Ciric
*Attorney, Agent, or Firm*—Rosenberg, Klein & Bilker

[57] ABSTRACT

A flashlight that forms a handhold of an umbrella is provided that includes a thimble threadedly connected to a sleeve barrel coupled to the shaft of an umbrella. A transparent disc, a lamp assembly and two batteries are disposed in the thimble. A conducting seat is positioned adjacent the lamp assembly and has a hollow sleeve through which a push rod passes to turn the flashlight on and off.

6 Claims, 3 Drawing Sheets

COMBINED UMBRELLA HANDLE AND FLASHLIGHT

BACKGROUND OF THE INVENTION

1. Field of the Invention

The present invention relates to a flashlight, and more particularly to a flashlight attached to the handhold of an umbrella.

2. Prior Art

A conventional flashlight is an individual device. In daily life, many articles have a handhold for being grasped with a hand, but they do not have a lighting function. At night, one hand holds the handhold and the other hand has to hold a flashlight for lighting, so that the two hands are both occupied. It is not convenient to carry an article and a separate flashlight for lighting a user's way.

SUMMARY OF THE INVENTION

It is therefore one object of this invention to provide a flashlight attached to a handhold, such as a handhold of an umbrella, so that the umbrella has a double function.

The present invention includes a thimble threadedly joined to a sleeve barrel extending therefrom. A transparent disc, a lamp set, two batteries and a conducting strip are combined to provide a lighting system within the thimble. Screwing the thimble in or out controls the turning on or off of the flashlight. At the other end, the structure forms a conventional handhold for an automatic telescopic umbrella, an automatic open umbrella or a manually operated umbrella.

DETAILED DESCRIPTION OF THE PREFERRED EMBODIMENTS

Figure 1:
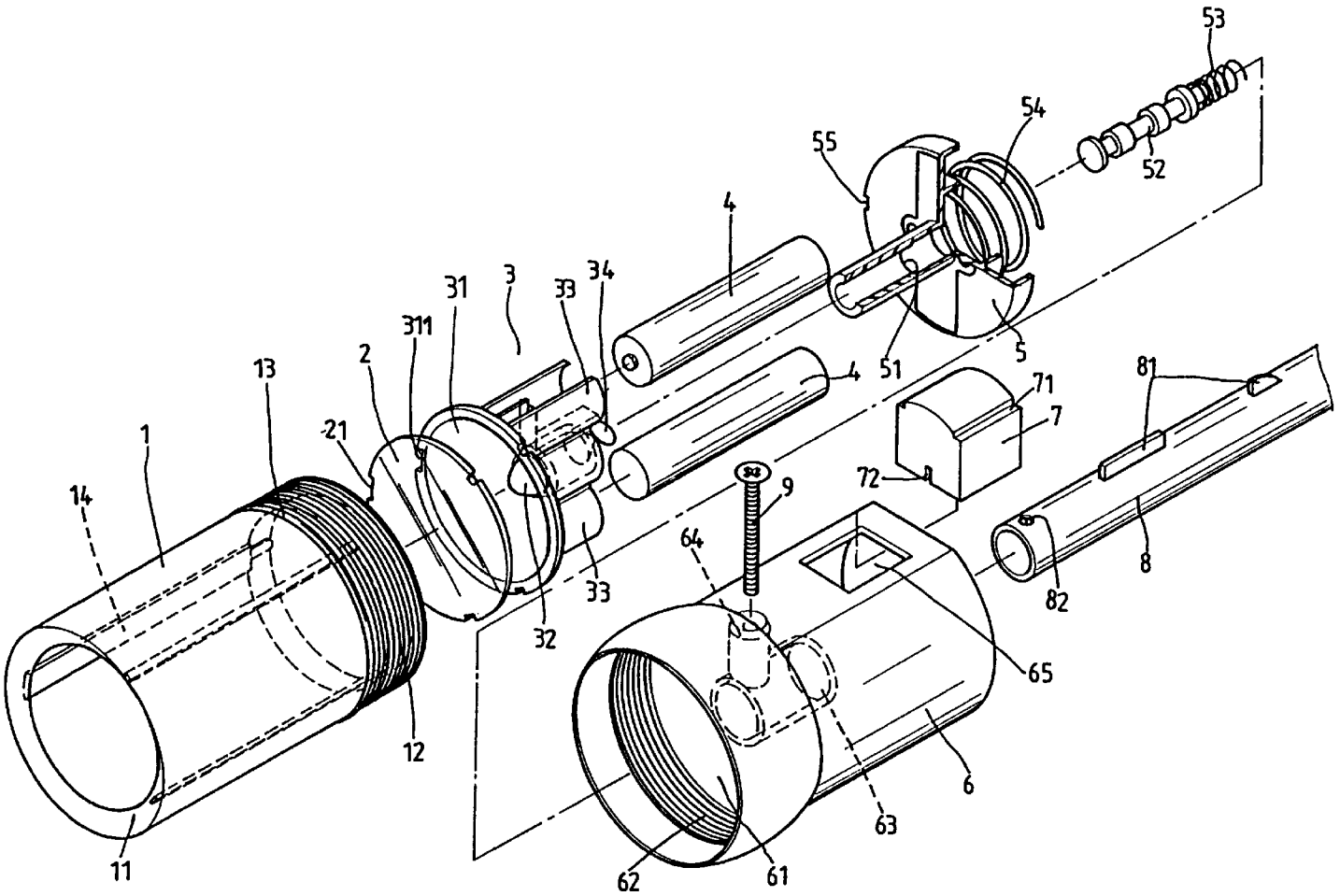
FIG. 1 is an exploded view of the present invention.

Referring to FIG. 1, the present invention includes a thimble 1, a transparent disc 2, a lamp set, two batteries 4, a conducting seat 5, a sleeve barrel 6 and a button 7, cooperating with the main trunk 8 of an umbrella.

The thimble 1 is a hollow tube with both ends open. One end of the thimble 1 has a drawn-in rim 11, and the other end has a male thread 12 formed thereon with a sealing lip 13 formed at the root of the male thread 12. Three fins 14 are formed axially on the inside wall of the thimble 1.

The transparent disc 2 is a flat plate with three notches 21 that fit on the fins 14 of the thimble 1, respectively. The disc 2 rests against the drawn-in rim 11. The lamp set 3 consists of a shade holder 31, a bulb 32 disposed at the center of the shade holder 31, two sleeves 33 formed on the back side of the shade holder 31 adjacent the back end of the bulb 32 for housing the two batteries 4, respectively. A conducting strip 34 is laid into the end of one sleeve 33 and connected to the side terminal of the bulb 32. Another conducting strip 34 has one end laid into the other sleeve 33, and the other end is disposed adjacent the back side of the back terminal of the bulb 32. Three notches 311 are formed at the edge of the shade holder 31 for fitting on the fins 14 of the thimble 1, respectively, for preventing the shade holder 31 from turning within the thimble 1.

The conducting seat 5 is a disc with a hollow sleeve portion located at the center of the upper side thereof. There is a shoulder 51 formed centrally in the center hole for stopping a push rod 52 from passing through the center hole and extending out from the top end of the center sleeve with the upper end. A small spring 53 is provided to push back the bottom end of the push rod 52, and a large spring 54 pushes back the bottom side of the conducting seat 5. Three notches 55 are formed at the edge of the conducting seat 5 for fitting on the fins 14 of the thimble 1, respectively, for sliding into the thimble 1.

The sleeve barrel 6 is a cylinder with a septum 61 formed at a proper position to divide the sleeve barrel 6 into two open thimbles. There is a female thread 62 formed in the inside of one open end for threadedly engaging the male thread 12 of the thimble 1. The other open end of the sleeve barrel 6 has a socket 63 formed centrally on the inside thereof. A radially directed post: 64 with a threaded hole intersects a side of the socket 63 and extends to an outer surface of the sleeve barrel 6. An opening 65 is formed at a proper location on the sleeve barrel 6. The button 7 is set into the opening 65 on the sleeve barrel 6, and has a step edge 71 that rests against the inside rim of the opening 65 to prevent the button 7 from sliding out. A slot 72 is formed on the bottom side of the button 7. The main shell 8 of the umbrella has a trip lever 81 disposed adjacent the bottom portion thereof for automatically controlling the opening of the umbrella. A through hole 82 is formed adjacent the bottom end of shaft 8.

Figure 2:
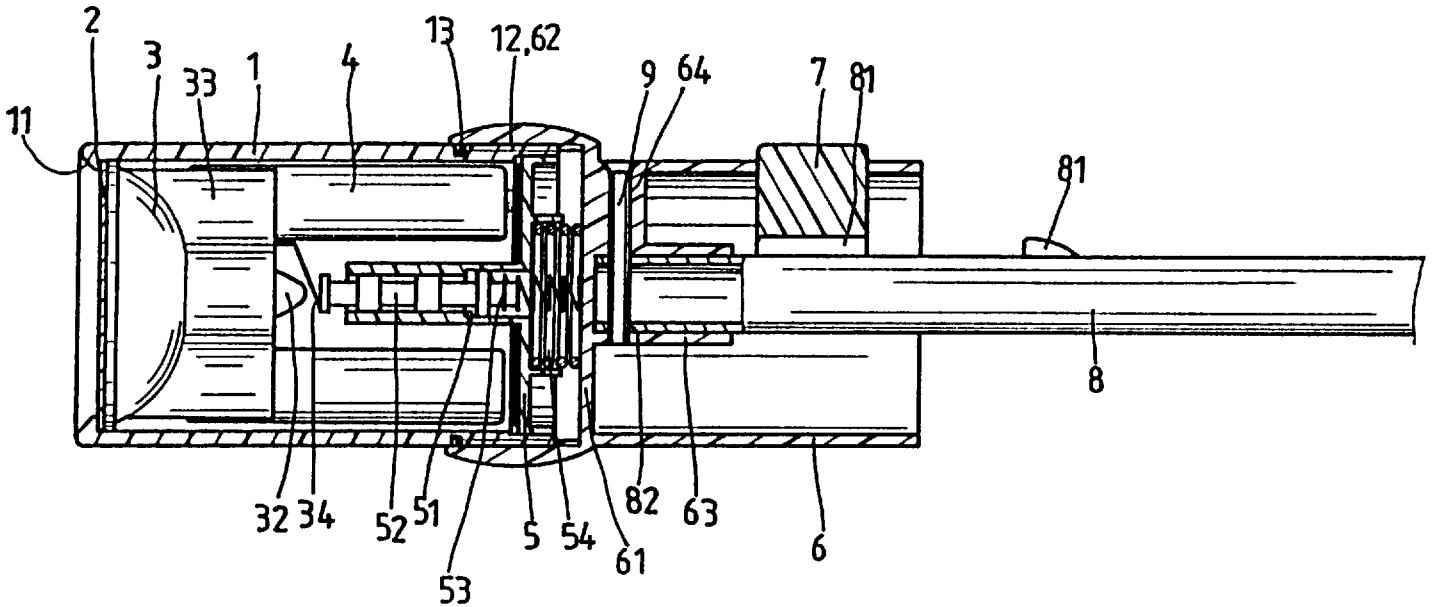
FIG. 2 is a cross-section view showing the present invention in an off state; and, FIG. 3 is a cross-section view showing the present invention in an on state.

Referring to FIG. 2, the transparent disc 2, the lamp set 3, the two batteries 4 and the conducting seat 5 are placed into the thimble 1 sequentially. Then, by screwing the male thread 12 into the female thread 62, the thimble 1 is joined to the sleeve barrel 6. By means of the blind end 61, the large spring 54 and the small spring 53 push against the back ends of the push rod 52 and the conducting seat 5, to prevent all the components inside from being displaced. At the other side of the sleeve barrel 6, the main shaft of an umbrella is plunged into the socket 63 and affixed therein by a screw 9 threaded into the through hole 82 through the threaded hole of post 64. The button 7 is inserted into the opening 65 with the trip 81 of the main shaft 8 of the umbrella inserted into the slot 72 of button 7, so that pressing down on the button 7 opens the umbrella automatically. The thimble 1 and the sleeve barrel 6 are combined together to form a handhold of the umbrella.

Figure 3:
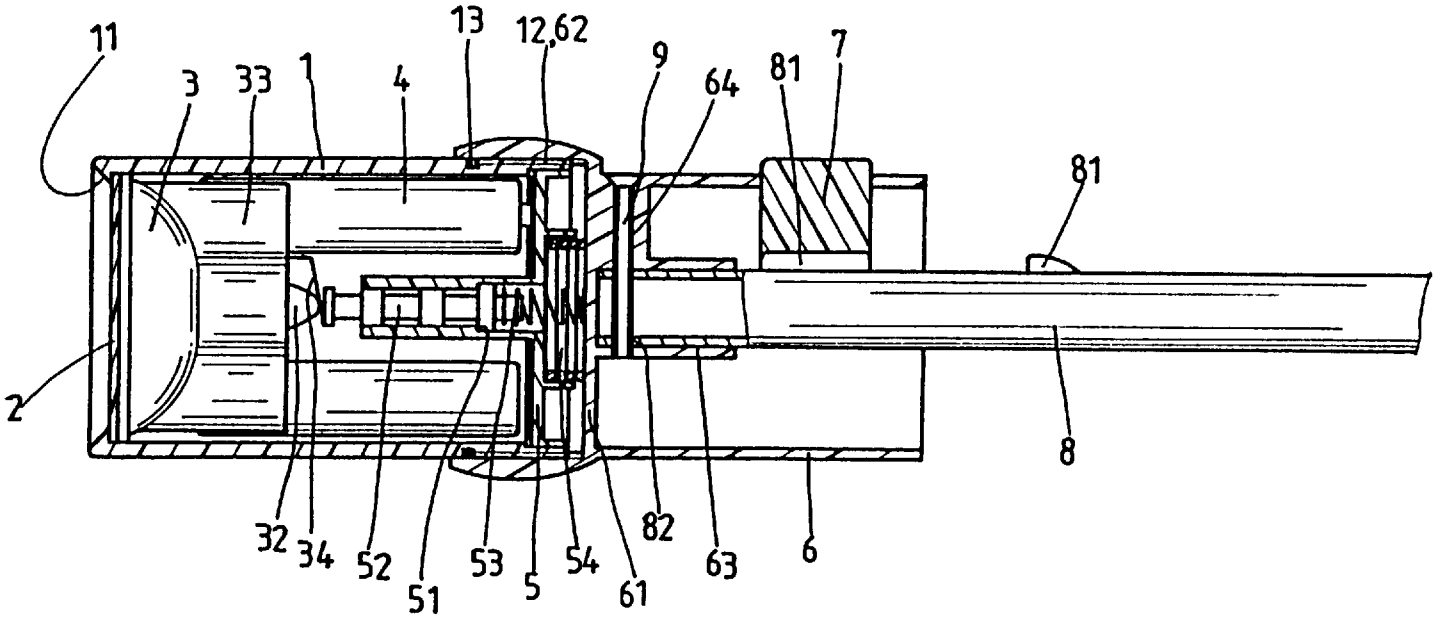

In practice, with reference to FIG. 2 and FIG. 3, the threaded connection between the thimble 1 and the sleeve barrel 6, when loosened or tightened, displaces the push rod 52. Screwing the thimble 1 in or out makes the end of the conducting strip 34 adjacent the back terminal of the bulb 32 contact the back terminal of the bulb 4 or break contact, the conducting strip 34 being displaced by the displacement of push rod 52, in order to turn the bulb 32.

I claim:

1. A combined umbrella handle and flashlight, comprising:

a sleeve barrel having opposing first and second open ends and an internal septum dividing said sleeve barrel into two compartments, said septum being coupled to an umbrella shaft extending through said second open end:

a thimble member threadedly connected to said first open end of said sleeve barrel to form a flashlight housing, said thimble member being formed by a hollow longitudinally extended tube having a pair of opposing open ends, one of said ends having a drawn-in rim and the opposing end having an external thread formed thereon with a sealing lip disposed at a root of said external thread, said thimble member having a plurality of fins formed longitudinally on an internal wall surface of said thimble member;

a transparent disc disposed within said flashlight housing adjacent a distal end thereof, said transparent disc having a planar contour with a plurality of notches formed in a peripheral edge thereof for respectively receiving said plurality of fins therein and being disposed contiguous said drawn-in rim;

a lamp set disposed within said flashlight housing adjacent said transparent disc, said lamp set including a pair of batteries and a light bulb; and, a conducting seat disposed within said flashlight housing adjacent said lamp set for electrically coupling said pair of batteries to said light bulb responsive to a tightening of said threaded engagement of said thimble member to said sleeve barrel.

2. The combined umbrella handle and flashlight as recited in claim 1 where said lamp set includes a shade holder with said light bulb being centrally positioned therein and a plurality of notches formed in a peripheral edge thereof for respectively receiving said plurality of fins therein, said shade holder having a pair of sleeves formed on a rear side thereof for holding the pair of batteries therein, said lamp set including a pair of conducting strips, a first of said pair of conducting strips being disposed in one of said pair of sleeves and having an extending end portion thereof contacting a side terminal of said light bulb, a second of said pair of conducting strips being disposed in the other of said pair of sleeves and having an extending end portion thereof being disposed adjacent a rear terminal of said light bulb.

3. The combined umbrella handle and flashlight as recited in claim 2 further comprising:

a push rod, said conducting seat having a disc shaped contour with a centrally disposed hollow sleeve portion extending from a front surface thereof, said push rod extending through said hollow sleeve portion of said conducting seat for displacing said end portion of said second conducting strip into contiguous contact with said rear terminal of said light bulb for turning on said light bulb;

a small spring disposed between said push rod and said septum of said sleeve barrel for applying a bias force to said push rod; and, a large spring disposed between said conducting seat and said septum of said sleeve barrel for applying a bias force to said conducting seat.

4. The combined umbrella handle and flashlight as recited in claim 3 where said sleeve barrel has an internal thread formed on said first open end for coupling with said external thread of said thimble member, said push rod being displaced to turn on said light bulb responsive to a tightening of said threaded connection between said thimble member and said sleeve barrel.

5. The combined umbrella handle and flashlight as recited in claim 4 where said sleeve barrel has a centrally disposed socket formed on said septum with an opening for receiving an umbrella shaft therein and a radially directed post extending from a side wall of said socket with a threaded bore extending therethrough in open communication with said opening of said socket for receiving a screw therein to secure the umbrella shaft.

6. The combined umbrella handle and flashlight as recited in claim 5 further comprising a button extending through an opening formed through said sleeve barrel, said button having a slot formed in a bottom surface thereof for engaging a trigger member of the umbrella to displace the trigger member responsive to displacement of said button and thereby automatically open the umbrella.

* * * * *